US006113410A

United States Patent [19]

Heit et al.

[11] Patent Number: 6,113,410

[45] Date of Patent: Sep. 5, 2000

[54] RF CONNECTOR LOCK

[75] Inventors: Henry R. Heit; Thomas S. Holahan, both of Gahanna; Frank V. Myers, Westerville; George D. Lamach, Reynoldsburg, all of Ohio

[73] Assignee: Lucent Technologies Inc., Murray Hill, N.J.

[21] Appl. No.: 09/179,769

[22] Filed: Oct. 27, 1998

[51] Int. Cl.[7] ..... H01R 4/38; H01R 13/62

[52] U.S. Cl. ..... 439/321; 411/304

[58] Field of Search ..... 439/321, 277, 439/320; 411/302, 304

[56] References Cited

U.S. PATENT DOCUMENTS

| | | | |
|---|---|---|---|
| 3,306,330 | 2/1967 | Wallace | 411/304 |
| 4,354,721 | 10/1982 | Luzzi | 339/94 R |
| 5,116,265 | 5/1992 | Brown et al. | 439/801 |
| 5,586,854 | 12/1996 | Sakai et al. | 411/429 |
| 5,607,720 | 3/1997 | Wallace et al. | 427/181 |
| 5,857,865 | 1/1999 | Shimirak | 439/277 |

*Primary Examiner*—Neil Abrams
*Assistant Examiner*—Javaid Nasri

[57] ABSTRACT

An RF connector includes a shell that forms a cavity with the shell including external threads having a recessed portion therein which does not extend into the cavity so as not to cause a disruption in a signal transmitted through the connector. A locking slug is secured within the recessed portion for example by using an adhesive. The locking slug increases friction between the external threads and complementary internal threads of an interface plug to prevent the RF connector from loosening from the interface plug.

14 Claims, 3 Drawing Sheets

RF CONNECTOR LOCK

BACKGROUND OF THE INVENTION

The present invention relates in general to radio frequency (RF) connectors, and, more particularly, to RF connectors having locking slugs on external threads of the connectors.

RF connectors are used in the transmission of RF signals to interconnect cables and other components which carry RF signals. There are of number of different type of cables and components which carry RF signals such that RF connectors are also used to connect different types of cables and/or components together.

RF connectors include one or more jacks and/or one or more interface plugs which receive the jacks therein and the connectors are formed in a large variety of different configurations for accommodating various interconnecting applications. However, each interconnection includes one jack which receives a single mating plug. Jacks and plugs may be held together by friction or, more commonly, the jacks have external threads which are received into internal threads formed in the plugs. The cores of the connectors in jacks include receptacles to receive a transmission pin or wire extending within matching plugs.

It is important for each jack to be firmly secured to its corresponding interface plug to maintain the integrity of the signal passing through the RF connector since a "loose" connection may result in signal loss or unacceptable attenuation. Unfortunately, systems utilizing RF connectors are subject to vibration during transport between the manufacturing site and the user site as well as during use which tends to cause the RF connectors to become unacceptably loosened. The end-user is therefore required to check each and every connector upon receipt and periodically during use to ensure there are no loose RF connections. Such tightening operations are time consuming and may be overlooked even though they are important for the proper transmission of RF signals.

Accordingly, to overcome this problem in the prior art there is a need for an RF connector having a locking mechanism to hold intermated RF connectors together. Preferably, the locking mechanism would be formed on the external threads of jack portions of the connectors so as to prevent loosening of once secured RF connections as a result of vibrations. There is a further need for RF connectors having such a locking mechanism that does not interfere or adversely affect the transmission of RF signals through the connector. Preferably, such a connector would be relatively inexpensive and easy to use.

SUMMARY OF THE INVENTION

The present invention meets this need by providing an RF connector having a shell that forms a cavity with the shell including external threads having a recess or recessed portion formed therein for the locking mechanism. The recessed portion does not extend through the shell into the cavity so as not to disrupt RF signal transmissions passing through the connector. A locking slug is secured within the recessed portion, for example, by using an adhesive or by being molded in place. The locking slug extends above the external threads such that it increases friction between the external threads and complementary internal threads of an interface plug to prevent the RF connector from loosening from the interface plug.

According to a first aspect of the present invention, a radio frequency (RF) connector comprises a shell having external threads and a locking slug. The locking slug is positioned within a portion of the external threads providing friction between the external threads and complementary internal threads of an interface plug.

Preferably, the locking slug is secured within the portion of the external threads by an adhesive. The locking slug may comprise polymeric material, such as fluoropolymers or polyamides. The portion of the external threads in which the locking slug is positioned is located so that the locking slug engages a leading portion of the internal threads of the interface plug with the interface plug substantially completely engaging the RF connector. The RF connector may be of the type selected from type-connectors, SMA connectors or APC 35 connectors.

Preferably, the RF connector has an operating frequency range from about 3 kHz to about 300 GHz. The locking slug may extend above an edge of the external threads and across a plurality of the external threads. The locking slug may extend approximately 5° to approximately 360° around the external threads. Preferably, the locking slug has a durometer hardness rating of approximately 50 in the B-range to approximately 60 in the D-range.

According to another aspect of the present invention, an RF connector comprises a shell forming a cavity of the RF connector and a locking slug. The shell comprises external threads therein and a recessed portion within the external threads that does not extend through the shell to the cavity. The locking slug is positioned within the recessed portion providing friction between the external threads and complementary internal threads of an interface plug.

Preferably, the locking slug is secured within the portion of the external threads by an adhesive. The locking slug may comprise polymeric material, such as fluoropolymers or polyamides. The portion of the external threads in which the locking slug is positioned is located so that the locking slug engages a leading portion of the internal threads of the interface plug with the interface plug substantially completely engaging the RF connector. The RF connector may be of the type selected from type-N connectors, SMA connectors or APC 35 connectors.

Preferably, the RF connector has an operating frequency range from about 3 kHz to about 300 GHz. The locking slug may extend above an edge of the external threads and across a plurality of the external threads. The locking slug may extend approximately 5° to approximately 360° around the external threads. Preferably, the locking slug has a durometer hardness rating of approximately 50 in the B-range to approximately 60 in the D-range.

According to yet another aspect of the present invention, a method of making a self-locking RF connector comprises providing an RF connector having a shell forming a cavity of the RF connector. The shell also comprises external threads. A recessed portion is formed in the shell within the external threads. A locking slug is secured within the recessed portion increasing friction between the external threads and complementary internal threads of an interface plug.

The step of securing a locking slug within the recessed portion may comprise securing a locking slug within the recessed portion using an adhesive. The step of forming a recessed portion in the shell within the external threads may comprise the step of forming the recessed portion so as not to extend through the shell to the cavity.

Accordingly, it is an object of the present invention to provide an RF connector having a locking mechanism on the external threads of the connector so as to prevent the connector from becoming loose as a result of vibrations. It is another object of the present invention to provide an RF connector having such a locking mechanism that does not interfere or adversely affect the transmission of RF signals through the connector. It is yet another object of the present invention to provide such a connector that is relatively inexpensive and easy to use.

Other features and advantages of the invention will be apparent from the following description, the accompanying drawings and the appended claims.

DETAILED DESCRIPTION OF THE INVENTION

Figure 1:
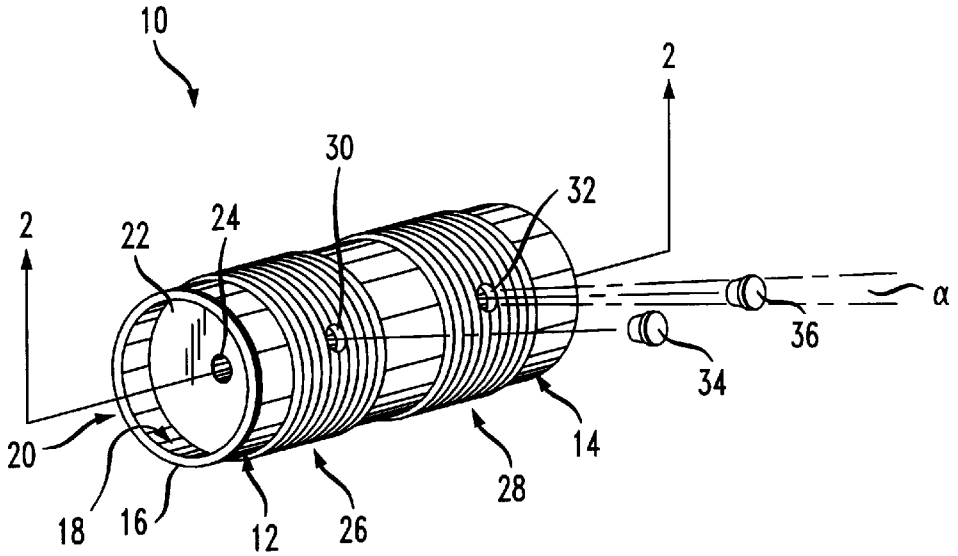
FIG. 1 is a partially exploded perspective view of an RF connector comprising a pair of jacks and including the invention of the present application.
Figure 2:
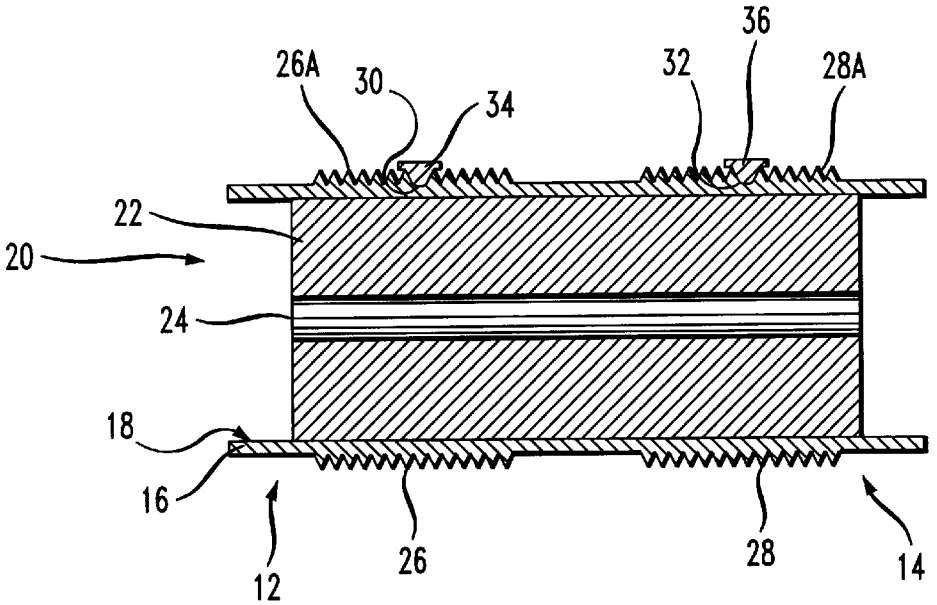
FIG. 2 is a cross-sectional view of the RF connector of FIG. 1 taken along section line 2—2 of FIG. 1.

Referring now to FIGS. 1 and 2, an RF connector 10 including the invention of the present application comprises a male-to-male adapter connector having a first jack 12 with external threads 26 therealong and a second jack 14 having external threads 28 therealong. The RF connector 10 comprises a shell 16 forming an internal cavity 18 which extends entirely through the shell 16. Positioned within the cavity 18 is a core 20 which extends between the first jack 12 and the second jack 14 and comprises a non-conductive insert 22 and a conductive receptacle 24 axially extending through the insert 22.

A first recessed portion 30 is formed within the first set of external threads 26 and a second recessed portion 32 is formed within the second set of external threads 28. A first locking slug 34 is secured within the first recessed portion 30 by molding the locking plug 34 into the recessed portion 30, by means of an appropriate adhesive, or otherwise as appropriate; and, a second locking slug 36 is secured within the second recessed portion 32 by molding the locking plug 36 into the recessed portion 32, by means of an appropriate adhesive or otherwise as appropriate. As shown in FIG. 2, the locking slugs 34, 36 each extend above an edge 26A, 28A of the external threads 26, 28, respectively. Further, the locking slugs 34, 36 extend across a plurality of the external threads 26, 28, respectively. In the illustrated embodiment, the locking slugs 34, 36 form an arc across the threads 26, 28 of approximately five degrees (5°), see a in FIG. 1. It will be appreciated by those skilled in the art that the locking slugs 34, 36 may range in dimensions from the approximately 5°, see 36 of FIG. 3, up to locking slugs which substantially completely encircle the threads 26, 28 with an arc of approximately 360°, see 34' of FIG. 3. Thus, the locking slugs 34, 36 may form any appropriate arc across the threads 26, 28 as required for a given application.

In the illustrated embodiment, the shell 16 of the RF connector 10 is comprised of gold while the locking slugs 34, 36 are comprised of a polymeric material. It will be appreciated by those skilled in the art that the shell 16 may be comprised of other appropriate materials for use with RF connectors. Preferably, the polymeric material for the slugs 34, 36 is selected from fluoropolymers or polyamides. One type of fluoropolymer that may be used is polytetrafluoroethylene commonly known as Teflon® which is a registered trademark of the DUPONT Company. The polyamides may be any appropriate Nylon. It will be appreciated by those skilled in the art that other types of material may be used to form the slugs 34, 36, such as appropriate thermoplastics or thermosets. If an adhesive is used to secure the slugs 34, 36 to the shell 16, preferably the adhesive is an epoxy that is compatible with the shell 16 and the slugs 34, 36.

Figure 3:
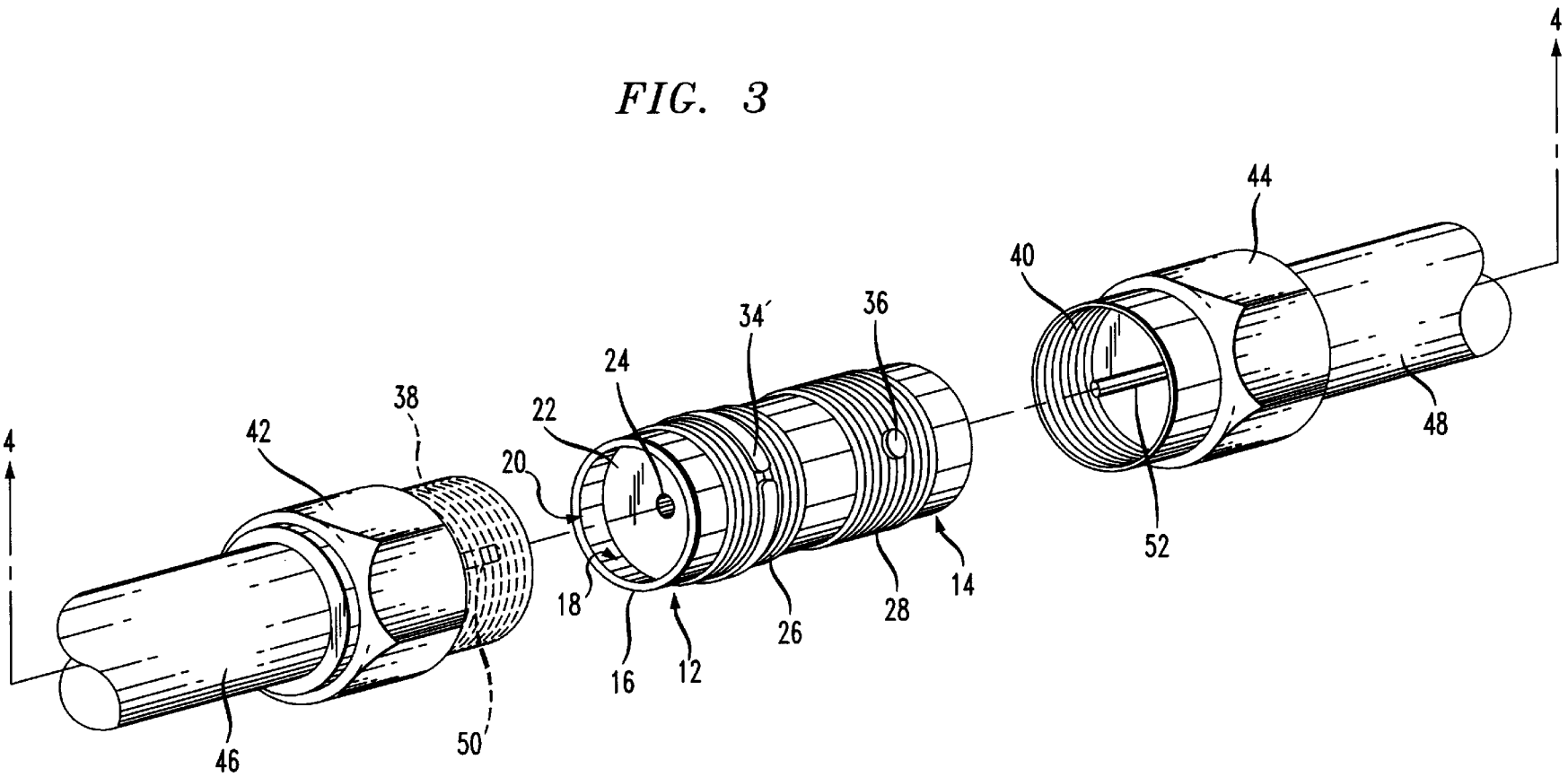
FIG. 3 is a perspective view of the RF connector of FIG. 1 showing corresponding connectors which include interface plugs for receiving the jacks of the connector of FIG. 1.
Figure 4:
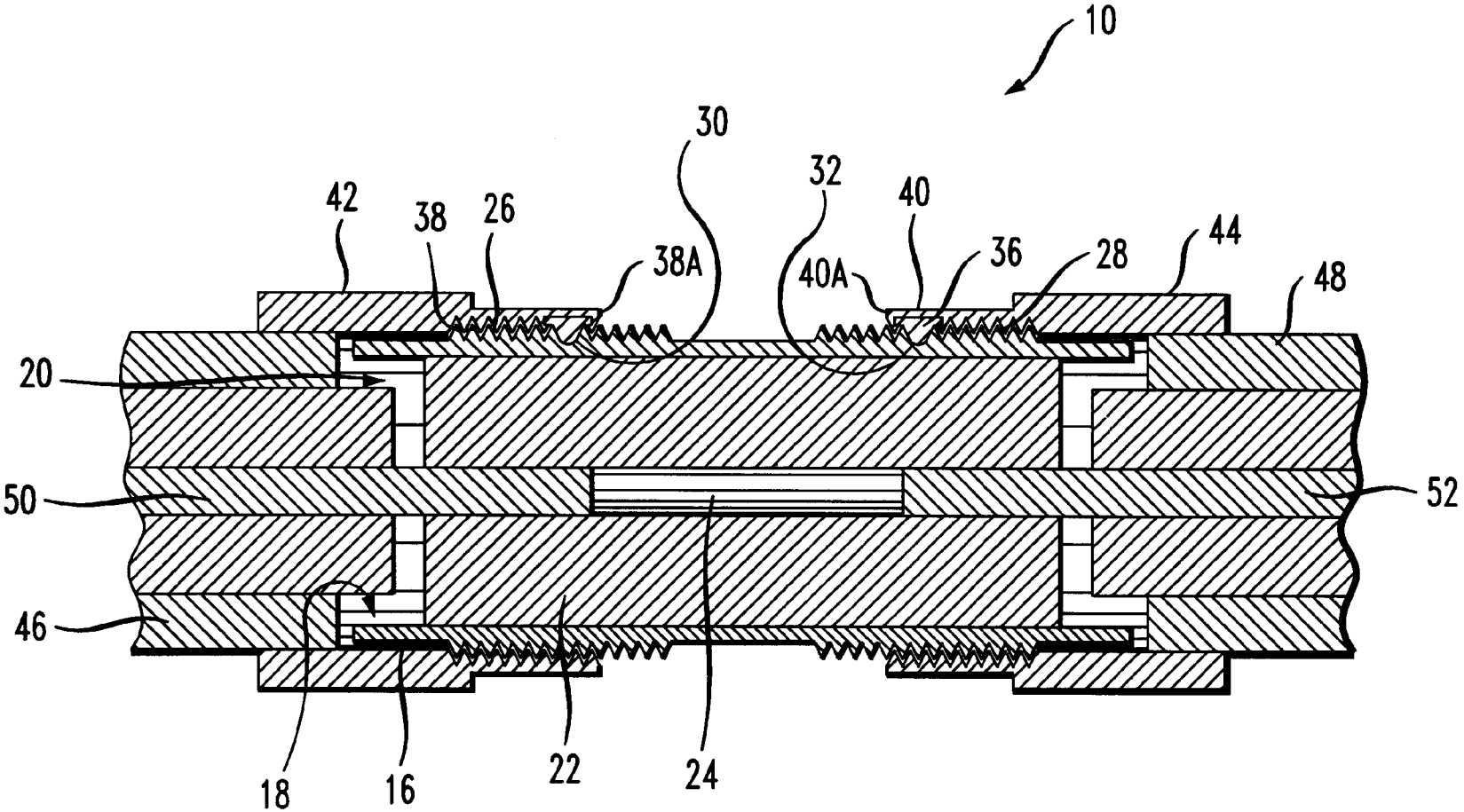
FIG. 4 is a cross-sectional view of the RF connectors of FIG. 3 after they have been fully intermated and taken along section line 4—4 of FIG. 3.

Referring now to FIGS. 3 and 4, the external threads 26, 28 of the first and second jacks 12, 14 are configured to interface with complementary internal threads 38, 40 of first and second interface plugs 42, 44. In the illustrated embodiment, the first and second interface plugs 42, 44 form portions of cables 46, 48 having conductors 50, 52 for transmitting RF signals.

Referring to FIG. 4, the interface plugs 42, 44 are mated to the first and second jacks 12, 14, respectively, such that the internal threads 38, 40 contact the locking slugs 34, 36. The locking slugs 34, 36 increase friction between the external threads 26, 28 and the internal threads 38, 40, respectively, to prevent the interface plugs 42, 44 from backing off of the jacks 12,14 as a result of vibrations associated with transport or other factors. The recessed portions 30, 32 into which the locking slugs 34, 36 are secured, and an adhesive if used, prevent the locking slugs 34, 36 from rotating as the interface plugs 42, 44 are screwed onto the jacks 12,14. It will be appreciated by those skilled in the art that the locking slugs 34, 36 may be secured to the jacks 12 14 in such a manner that the recessed portions 30, 32 are not required. The locking slugs 34, 36 may have any desired hardness so as to provide sufficient friction between the external threads 26, 28 and the internal threads 38, 40 and to allow the internal threads 38, 40 to pass over the external threads 26, 28. Preferably, the locking slugs 34, 36 have a durometer hardness rating of approximately 50 in the B-range to approximately 60 in the D-range.

As shown in FIG. 4, the recessed portions 30, 32 are positioned so that the locking slugs 34, 36 engage leading portions 38A, 40A of the internal threads 38, 40 of the interface plugs 42, 44 with the interface plugs 42, 44 completely engaging the jacks 12,14. The interface plugs 42, 44 are therefore almost completely engaging the jacks 12,14 before the locking slugs 34, 36 are engaged. Accordingly, the locking slugs 34, 36 increase friction between the internal threads 38, 40 and the external threads 26, 28 without the internal threads 38, 40 engaging the locking slugs 34, 36 along the entire length of each respective interface plug 42, 44. Such a configuration provides the necessary locking function without causing excess stress along the length of the interface plugs 42, 44.

As illustrated in FIG. 2, the first and second recessed portions 30, 32 do not extend through the shell 16 into the cavity 18. The RF connector 10 of the present invention is configured to operate in a frequency range of about 3 kHz to about 300 GHz. If the recessed portions 30, 32 extended through the shell 16 into the cavity 18, RF signals transmitted through the RF connector 10 in the above frequency range could be disrupted thereby resulting in transmission problems.

The RF connector 10 may comprise a variety of different types of standard connectors. For example, the RF connector 10 may comprise type-N connectors, SMA connectors or APC 3.5 connectors. Further, the RF connector 10 may include a number of different configurations, such as a right angle connector, a bulkhead connector, a series converting connector, and the like. In addition, the RF connector 10 of the present invention may include miniature connectors, subminiature connectors and microminiature connectors. Accordingly, it will be appreciated by those skilled in the art that the present invention is not limited to the illustrated embodiment but may include any appropriate RF connector having at least one set of external threads.

Having described the invention in detail and by reference to preferred embodiments thereof, it will be apparent that modifications and variations are possible without departing from the scope of the invention defined in the appended claims.

What is claimed is:

1. An RF connector comprising:

a shell forming a cavity of said RF connector, said shell comprising external threads and a recessed portion within said threads such that threads extend around said recessed portion and said recessed portion not extending through said shell to said cavity; and a locking slug positioned within said recessed portion, said locking slug providing friction between said external threads and complementary internal threads of an interface plug.

2. The RF connector of claim 1, wherein said locking slug is secured within said portion of said external threads by an adhesive.

3. The RF connector of claim 2, wherein said polymeric material is selected from fluoropolymers or polyamides.

4. The RF connector of claim 1, wherein said locking slug comprises polymeric material.

5. The RF connector of claim 1, wherein said portion of said external threads is positioned so that said locking slug engages a leading portion of said internal threads of said interface plug with said interface plug substantially completely engaging said RF connector.

6. The RF connector of claim 1, wherein said RF connector is of the type selected from type-N connectors, SMA connectors or APC 3.5 connectors.

7. The RF connector of claim 1, wherein said RF connector has an operating frequency range from about 3 kHz to about 300 GHz.

8. The RF connector of claim 1, wherein said locking slug extends above an edge of said external threads.

9. The RF connector of claim 1, wherein said locking slug extends across a plurality of said external threads.

10. The RF connector of claim 1, wherein said locking slug extends approximately 360° around said external threads.

11. The RF connector of claim 1, wherein said locking slug extends approximately 5° around said external threads.

12. The RF connector of claim 1, wherein said locking slug has a durometer hardness rating of approximately 50 in the B-range to approximately 60 in the D-range.

13. A method of making a self-locking RF connector, said method comprising the steps of:

providing an RF connector comprising a shell forming a cavity of said RF connector and said shell comprising external threads;

forming a recessed portion in said shell within said external threads so that threads extend around said recessed portion and said recessed portion does not extend through said shell to said cavity; and securing a locking slug within said recessed portion, said locking slug increasing friction between said external threads and complementary internal threads of an interface plug.

14. The method of claim 13, wherein said step of securing said locking slug within said recessed portion comprises securing said locking slug within said recessed portion using an adhesive.

* * * * *

UNITED STATES PATENT AND TRADEMARK OFFICE

CERTIFICATE OF CORRECTION

PATENT NO. : 6,113,410 
DATED : September 5, 2000
INVENTOR(S) : Henry R. Heit, Thomas S. Holahan, Frank V. Myers and George D. Lamach It is certified that error appears in the above-identified patent and that said Letters Patent is hereby corrected as shown below:

Column 5,
Lines 30-31, should read -- The RF connector of claim 1, wherein said locking slug comprises polymeric material. --

Lines 32-33, should read -- The RF connector of claim 3, wherein said polymeric material is selected from fluoropolymers or polyamides.

Signed and Sealed this

Twenty-fifth Day of June, 2002

*Attest:*

*Attesting Officer*

JAMES E. ROGAN
*Director of the United States Patent and Trademark Office*